US006622345B2

(12) United States Patent
Liu et al.

(10) Patent No.: US 6,622,345 B2
(45) Date of Patent: Sep. 23, 2003

(54) DOOR HINGE MECHANISM

(75) Inventors: Jun Liu, Milpitas, CA (US); Jeremy L. Neill, Gay, GA (US); Christopher L. Kight, Jackson, GA (US)

(73) Assignee: Hoshizaki America, Inc., Peachtree City, GA (US)

( * ) Notice: Subject to any disclaimer, the term of this patent is extended or adjusted under 35 U.S.C. 154(b) by 0 days.

(21) Appl. No.: 09/867,067

(22) Filed: May 29, 2001

(65) Prior Publication Data

US 2002/0178544 A1 Dec. 5, 2002

(51) Int. Cl.[7] ..... E05D 7/10

(52) U.S. Cl. ..... 16/357; 16/374; 16/239; 16/242; 312/139.1; 312/325; 312/326; 312/350

(58) Field of Search ..... 16/357, 239, 241, 16/242, 374, 377; 312/139.1, 322, 323, 325, 326, 350

(56) References Cited

U.S. PATENT DOCUMENTS

| | | | | | |
|---|---|---|---|---|---|
| 1,555,781 | A | * | 9/1925 | Amsden | 16/322 |
| 1,722,559 | A | * | 7/1929 | Soss | 100/172 |
| 3,344,462 | A | * | 10/1967 | Webster | 16/357 |
| 4,068,348 | A | * | 1/1978 | Chivers | 16/235 |
| 4,458,379 | A | | 7/1984 | Shelton | |
| 5,203,114 | A | | 4/1993 | Orlando | |
| 5,394,590 | A | * | 3/1995 | Yu | 126/25 R |
| 5,465,557 | A | * | 11/1995 | Harte | 16/289 |
| 5,836,481 | A | | 11/1998 | Strohmeyer et al. | |
| 6,401,229 | B1 | * | 6/2002 | Taugher | 250/201.5 |

FOREIGN PATENT DOCUMENTS

| | | | | |
|---|---|---|---|---|
| GB | 2070129 A | * | 1/1981 | E05D/3/06 |
| WO | WO 90/15991 | * | 6/1990 | E05D/3/06 |

* cited by examiner

*Primary Examiner*—Robert E. Pezzuto
*Assistant Examiner*—Alexandra K. Pechhold
(74) *Attorney, Agent, or Firm*—Kilpatrick Stockton LLP

(57) ABSTRACT

A simple and inexpensive hinge system or mechanism that may apply to the front panel or door so as to obtain an easy access to the inside without making the mechanism much more complicated or expensive. The hinge mechanism for a front panel or door is hingedly connected to an enclosure (or cabinet case) and comprises an axis (or shaft) and an axis supporting member having an opening that supports the axis at a first position for door swinging, at a second position for holding the door in a certain state, and at an intermediate position for the axis moving with or without any turning.

5 Claims, 10 Drawing Sheets

(a)

(b)

(c)

(d)

(e)

DOOR HINGE MECHANISM

BACKGROUND OF INVENTION

1. Field of the Invention

Figure 1:
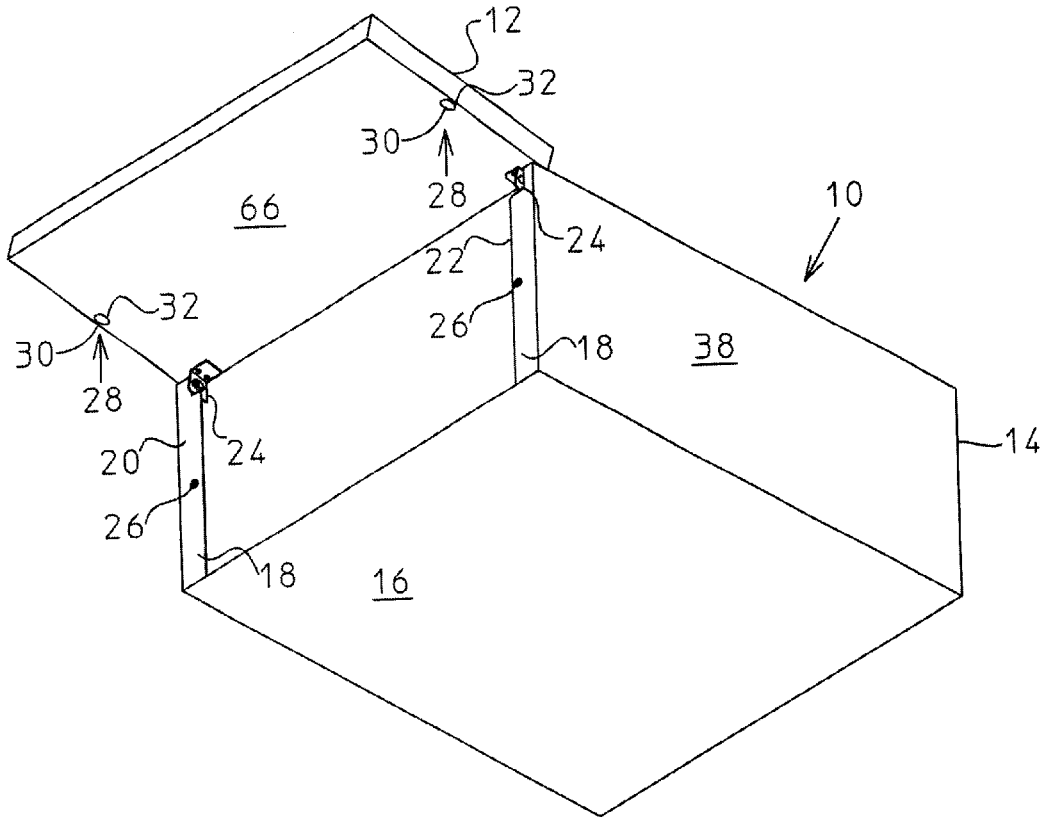

The present invention relates to a door housing and more particularly relates to a door hinge mechanism.

2. Description of the Related Art

A front panel of an appliance is conventionally screwed or bolted onto the appliance housing or case. The front panel improves the aesthetics, protects contained parts from harmful environment such as dust, prevents human or animal direct contact to the parts, and allows daily inspection through windows on the front panel without causing particular danger. The front panel is conventionally screwed or bolted, which is not expensive.

The appliance usually requires a regular maintenance, which may be conducted without removing the front panel but with utilizing small windows and access holes to adjust the equipment. However, on some occasion such as a major maintenance service and repair, the front panel may be needed to be removed from the appliance for the serviceman to access the inside of the appliance case. The front panel that is conventionally fixed on the appliance case may require a special tool and it may take long to unscrew (and screw) all screws on the front panel.

In order to obtain an easy access to the inside of the appliance, a front panel hingedly connected to the appliance case with a latch mechanism may be employed. However, a regular hinge does not keep the front panel open unless a special stopping mechanism is installed. Additional parts or equipment tends to complicate the hinged front panel system and to make it much more expensive.

SUMMARY OF THE INVENTION

The present invention seeks to provide a simple and inexpensive hinge system or mechanism that may apply to the front panel or door so as to obtain an easy access to the inside without making the mechanism much more complicated or expensive.

According to the present invention, the hinge mechanism for a front panel or door hingedly connected to an enclosure (or cabinet case) comprises an axis (or shaft) and an axis supporting member having an opening that supports the axis at a first position for door swinging, at a second position for holding the door in a certain state, and in a transition position for the axis moving with or without any turning.

According to another aspect of the present invention, the hinge mechanism mentioned above further comprises a latch mechanism for keeping the door steadily open.

According to yet another aspect of the present invention, the axis is fixed to the enclosure (or case) so that the door locking and latching movement can be made by pulling the door.

According to another aspect of the present invention, the hinge plate comprise a flat plate and a curved elongated opening so that the hinge mechanism can be simple.

According to another aspect of the present invention, the curved elongated opening of the axis support member has a partial bearing portion parallel with the door face and a curved-away-bearing portion from the door face, so that the hinged mechanism can utilize the door weight to latch or lock the door and create more space from the front opening trim so as to allow the hinge plate to turn around the axis.

According to another aspect of the present invention, the hinge plate comprises a projecting portion to engage with a latch edge portion secured to the case for keeping the door open.

According to another aspect of the present invention, the door lock mechanism is synchronized with the hinge mechanism so that the closed door may be prevented from vibrating and making noise with the case frame.

According to another aspect of the present invention, the hinge mechanism, the latch mechanism, and the lock mechanism may be installed separately to the cabinet case to which the door hingedly connected.

According to another aspect of the present invention, any kind of door-hingedly-connected-to-case system can apply any one of the hinged mechanisms mentioned above.

According to another aspect of the present invention, the hinge plate having an opening comprising a flat plate, a curved elongated opening, and a projecting portion so that the hinge mechanism may incorporate the latch mechanism.

BRIEF DESCRIPTIONS OF THE DRAWINGS

FIG. 1 is a perspective view from a lower position of a cabinet case with a door hingedly connected to the case, according to a preferred embodiment of the present invention. The door is held at an open position.

Figure 2:
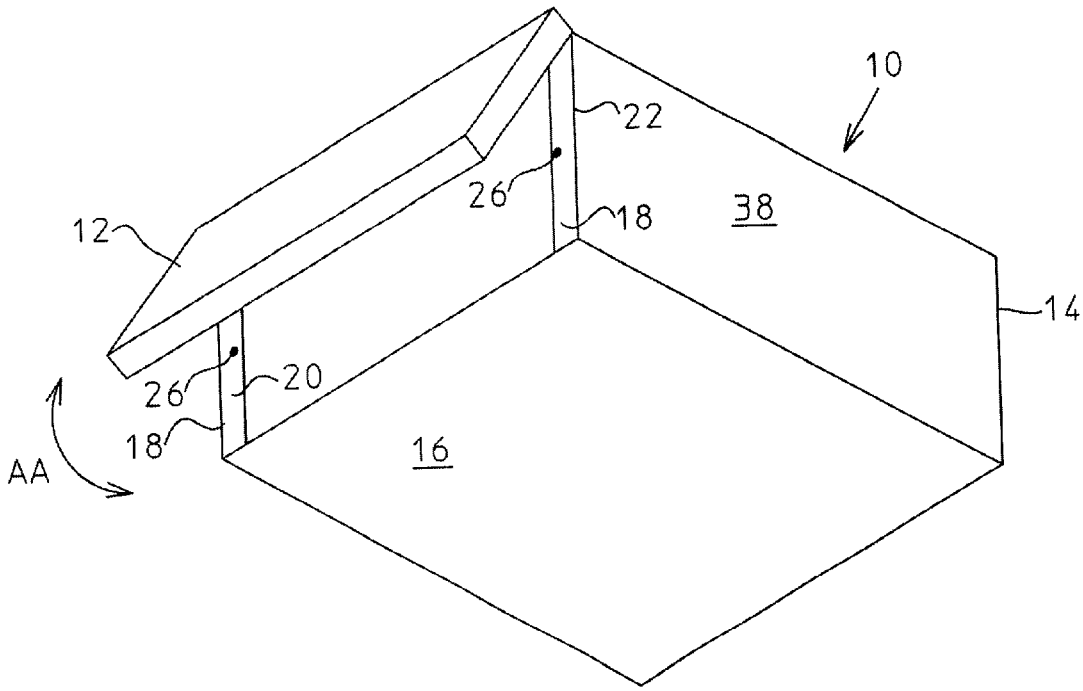

FIG. 2 is a perspective view from a lower position of the cabinet case shown in FIG. A, with the door hingedly connected to the case. The door swings up and down to open and close the case, respectively.

Figure 3:
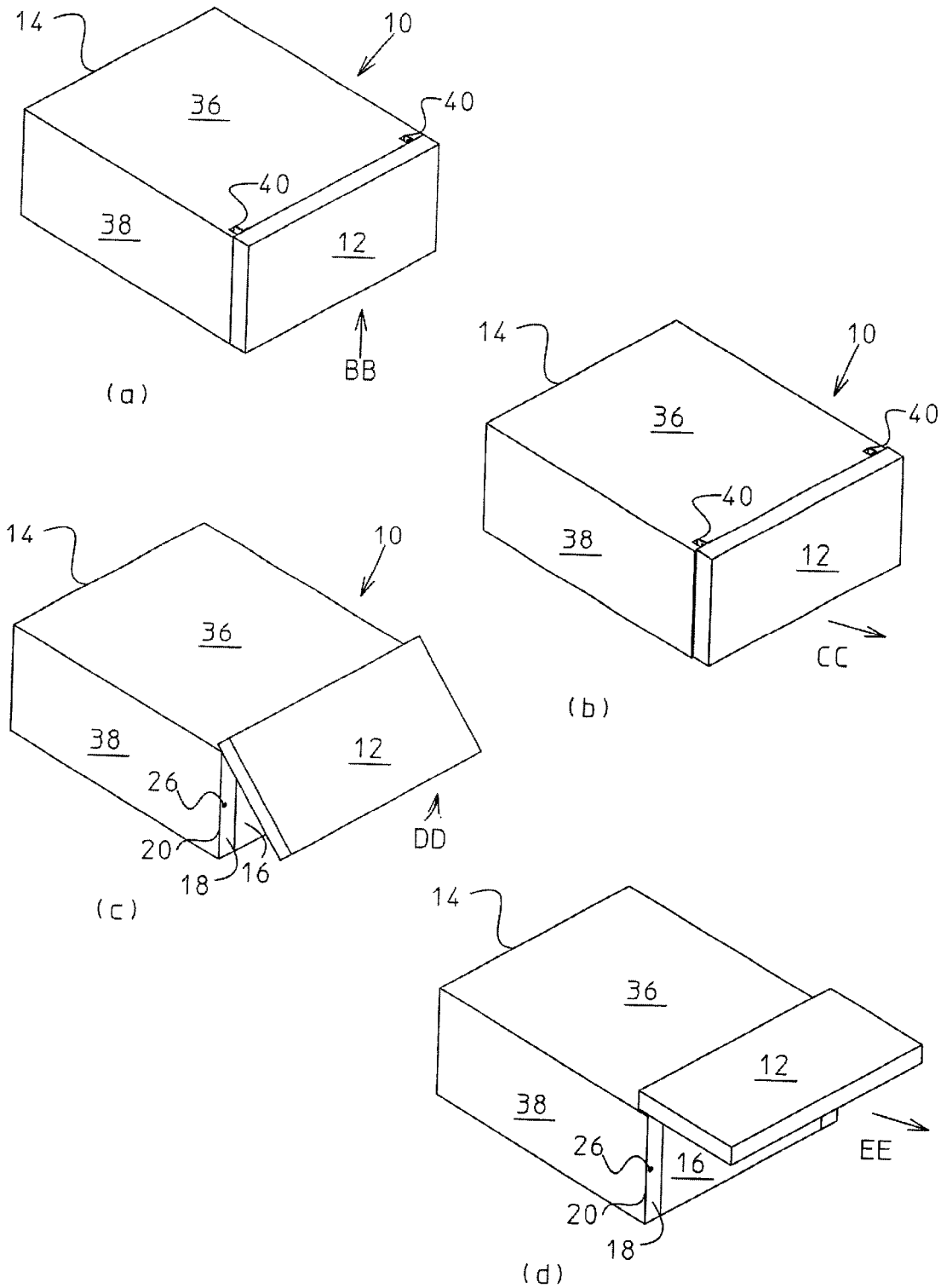

FIGS. 3(*a*)–(*d*) shows a door opening operation, for the embodiment of FIG. 1. FIG. 3(*a*) is a perspective view of the cabinet case with the door hingedly connected to the case when the cabinet case is closed. The door is in a closed position. FIG. 3(*b*) is a perspective view of the cabinet case with the door hingedly connected to the case when the cabinet case is about to open. The door is in a swinging position. FIG. 3(*c*) is a perspective view of the cabinet case with the door hingedly connected to the case when the cabinet case is opening. The door is in the swinging position. FIG. 3(*d*) is a perspective view of the cabinet case with the door hingedly connected to the case when the cabinet case is completely open and kept open. The door is in a latched position.

Figure 4:
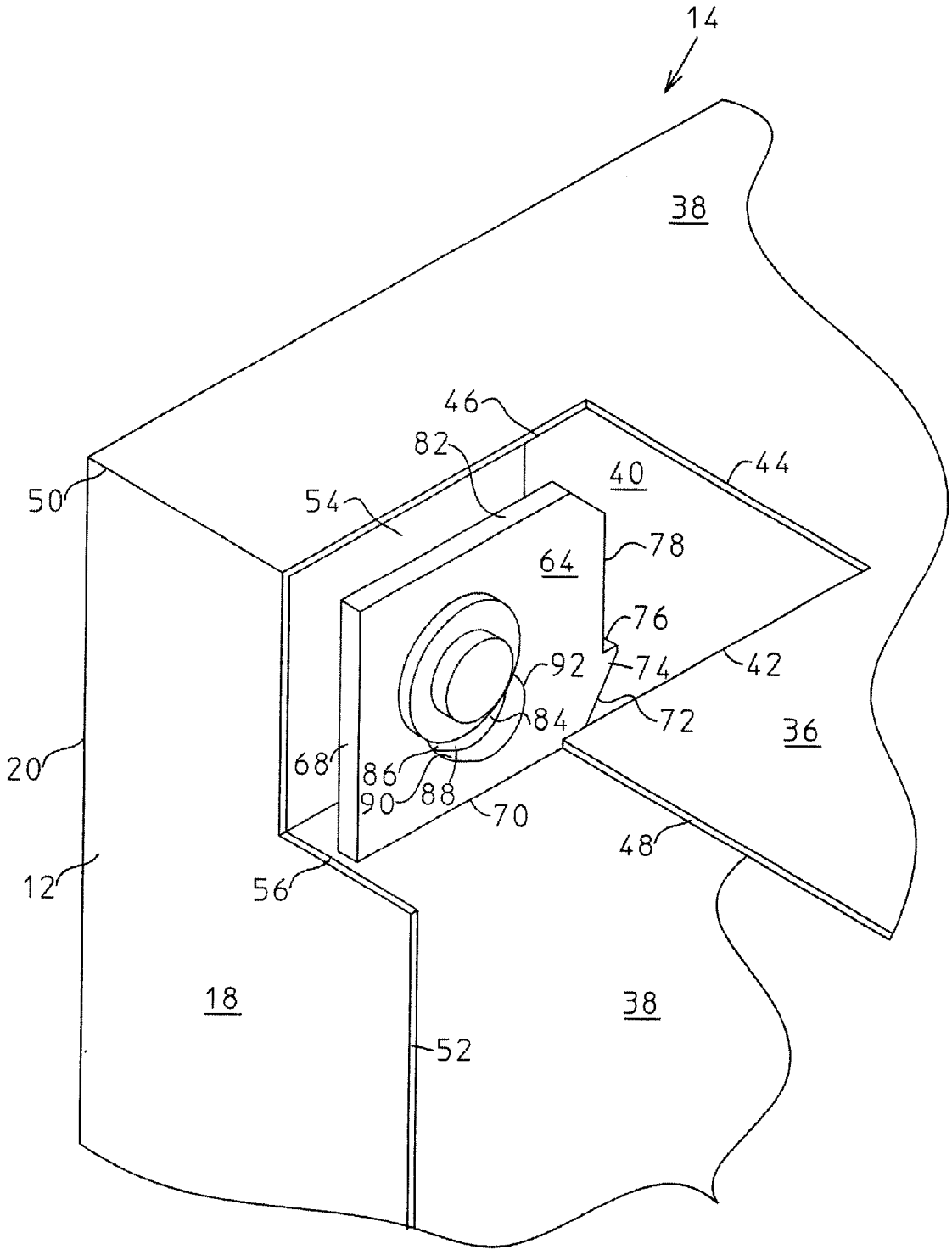
Figure 4:
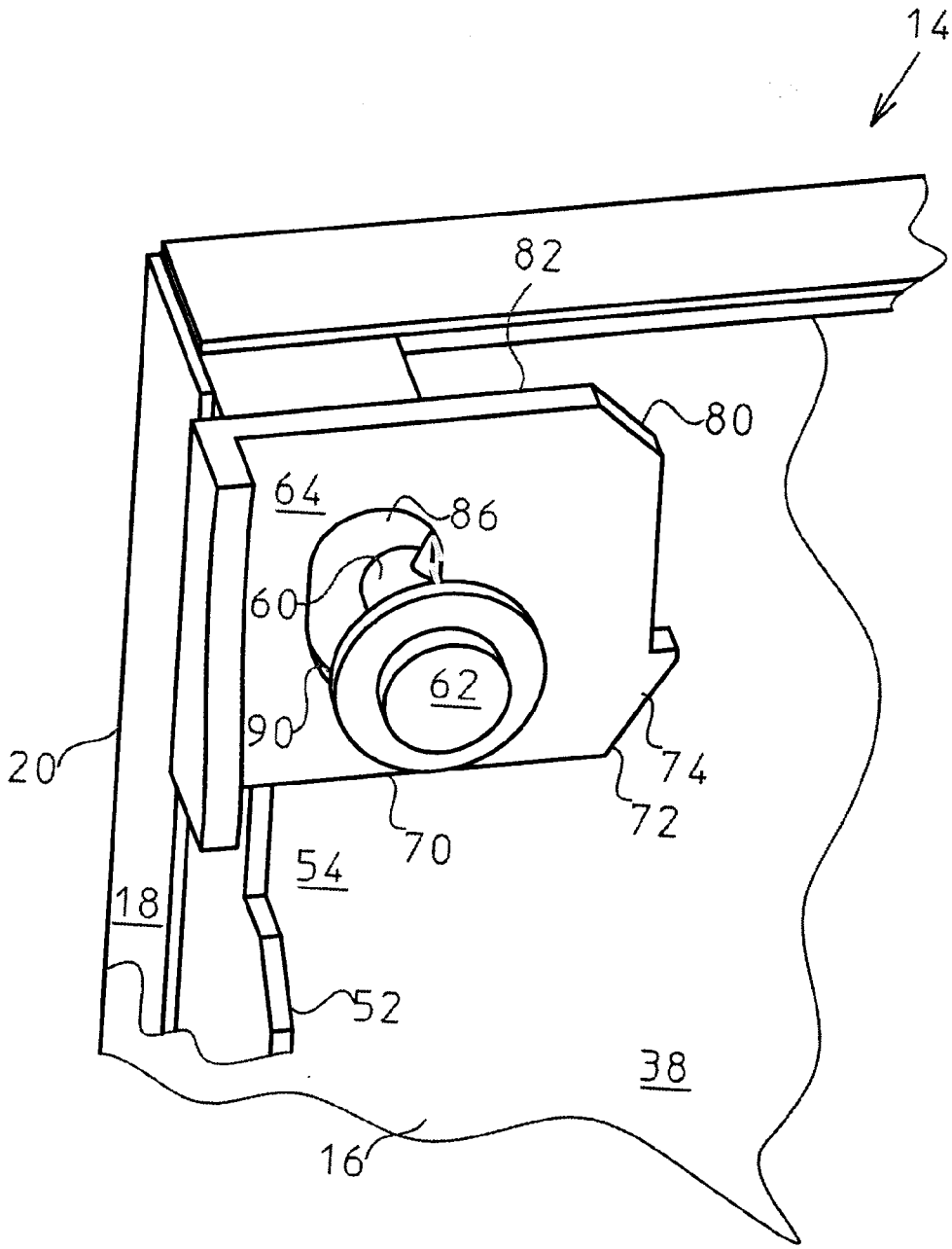
Figure 4:
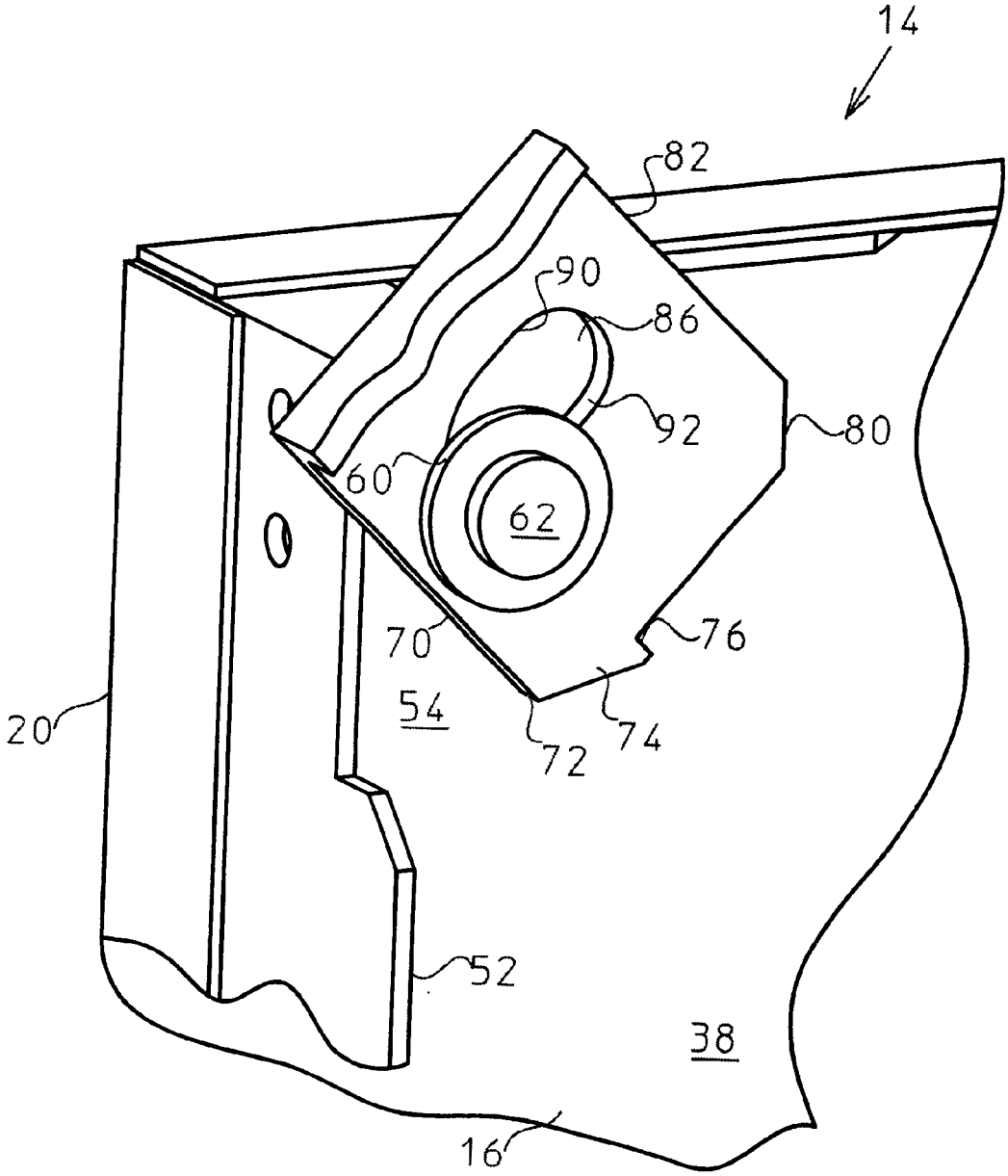
Figure 4:
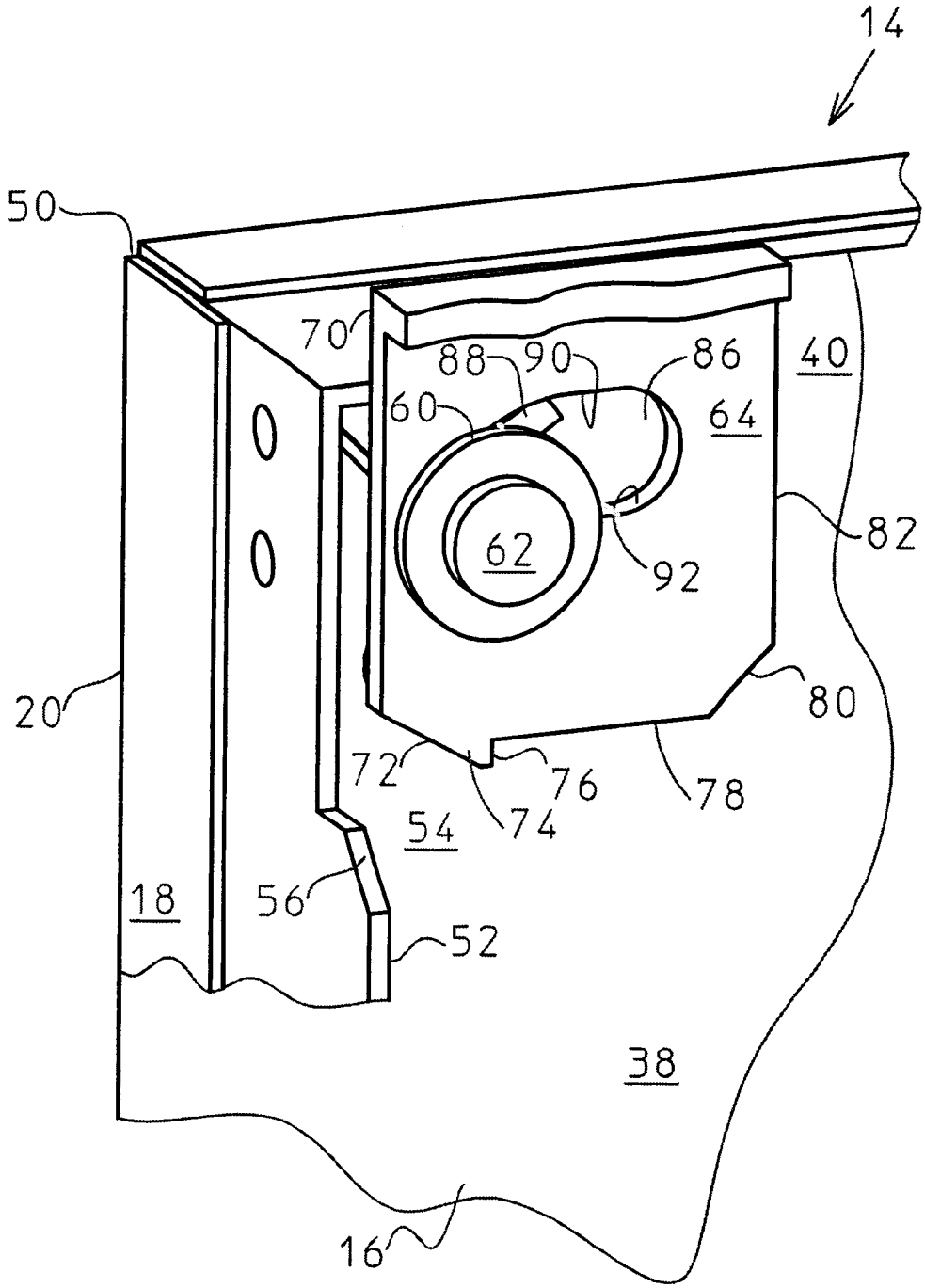
Figure 4:
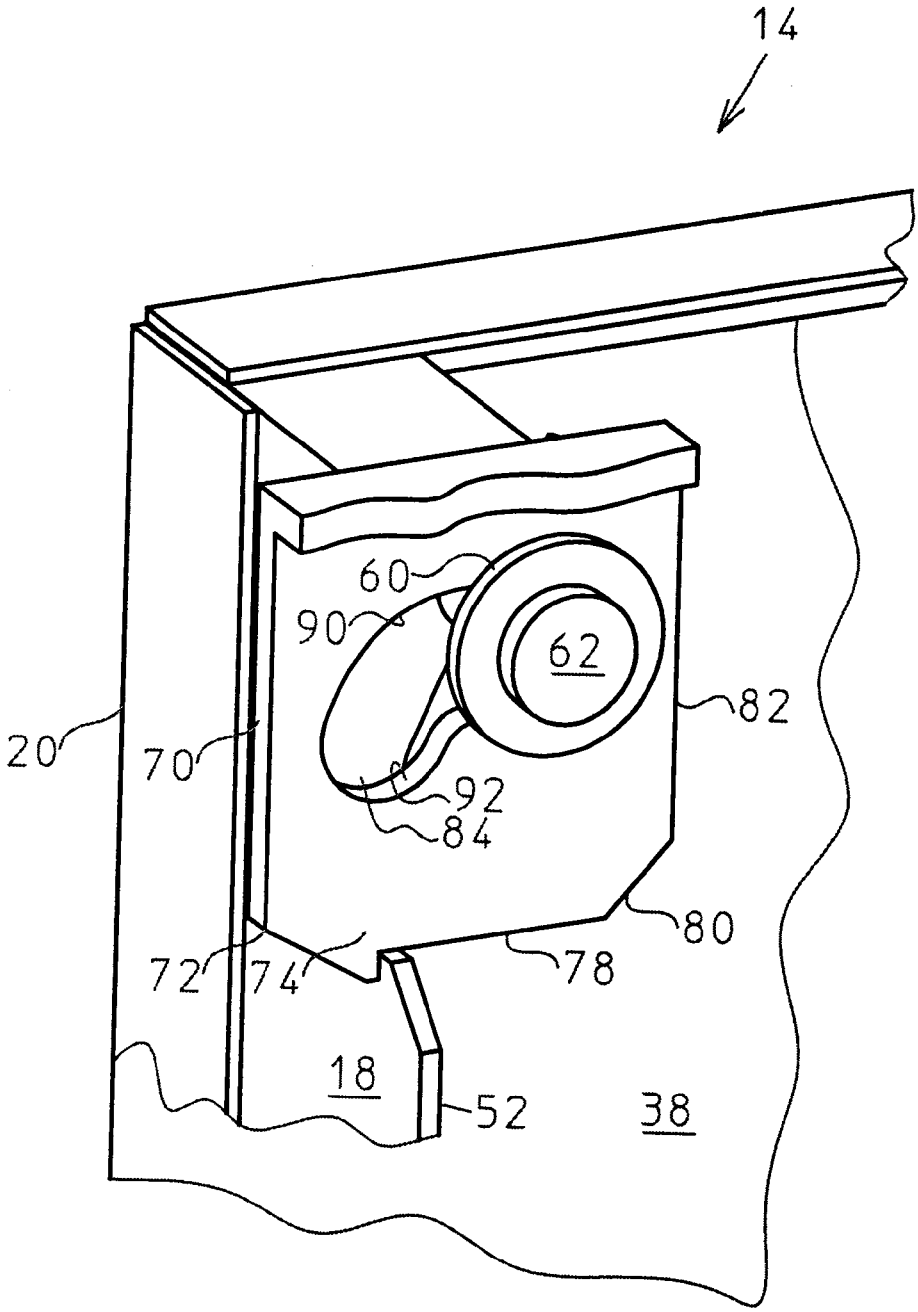

FIGS. 4(*a*)–(*e*) are perspective views of a left and top portion of the front opening for the embodiment of FIG. 1 with the door and cabinet case partially broken away to show operation of a hinge mechanism. FIG. 4(*a*) is a perspective view of the hinge mechanism when the door is in the closed position. FIG. 4(*b*) is a perspective view of the hinge mechanism when the door is pulled up to start to open the cabinet. The door (or axis) is in the swinging position. FIG. 4(*c*) is a perspective view of the hinge mechanism when the door is swinging to open the cabinet. The door (or axis) is in the swinging position. FIG. 4(*d*) is a perspective view of the hinge mechanism when the door is completely open. The door (or axis) is in the swinging position. FIG. 4(*e*) is a perspective view of the hinge mechanism when the door is pushed down onto an edge portion of a side plate of the case. The door is in the latched position.

Figure 5:
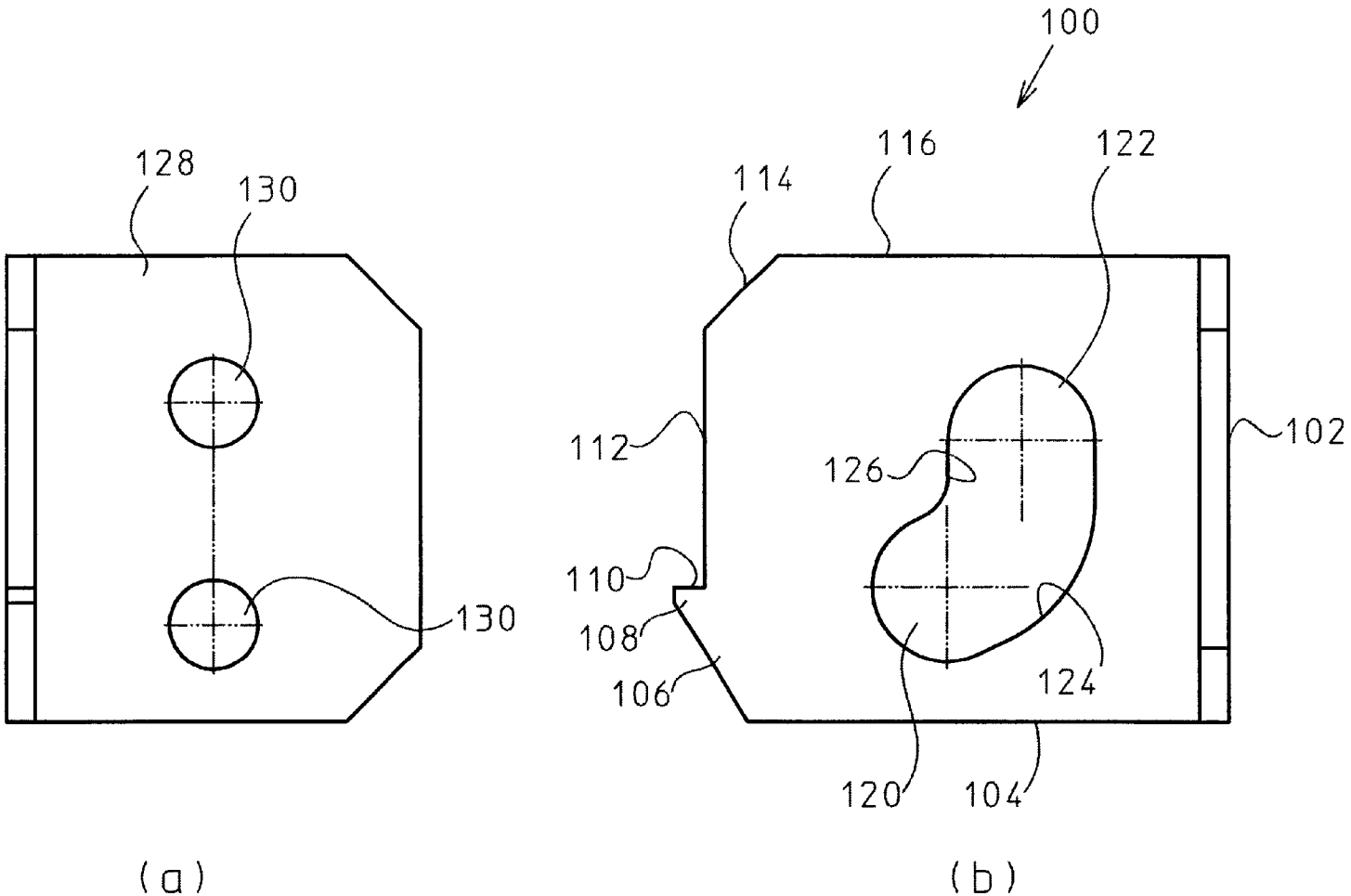

FIGS. 5(*a*) and (*b*) show a hinge bracket for the embodiment of FIG. 1. FIG. 5(*a*) is a side view of the hinge bracket. FIG. 5(*b*) is a plan view of the hinge bracket.

Figure 6:
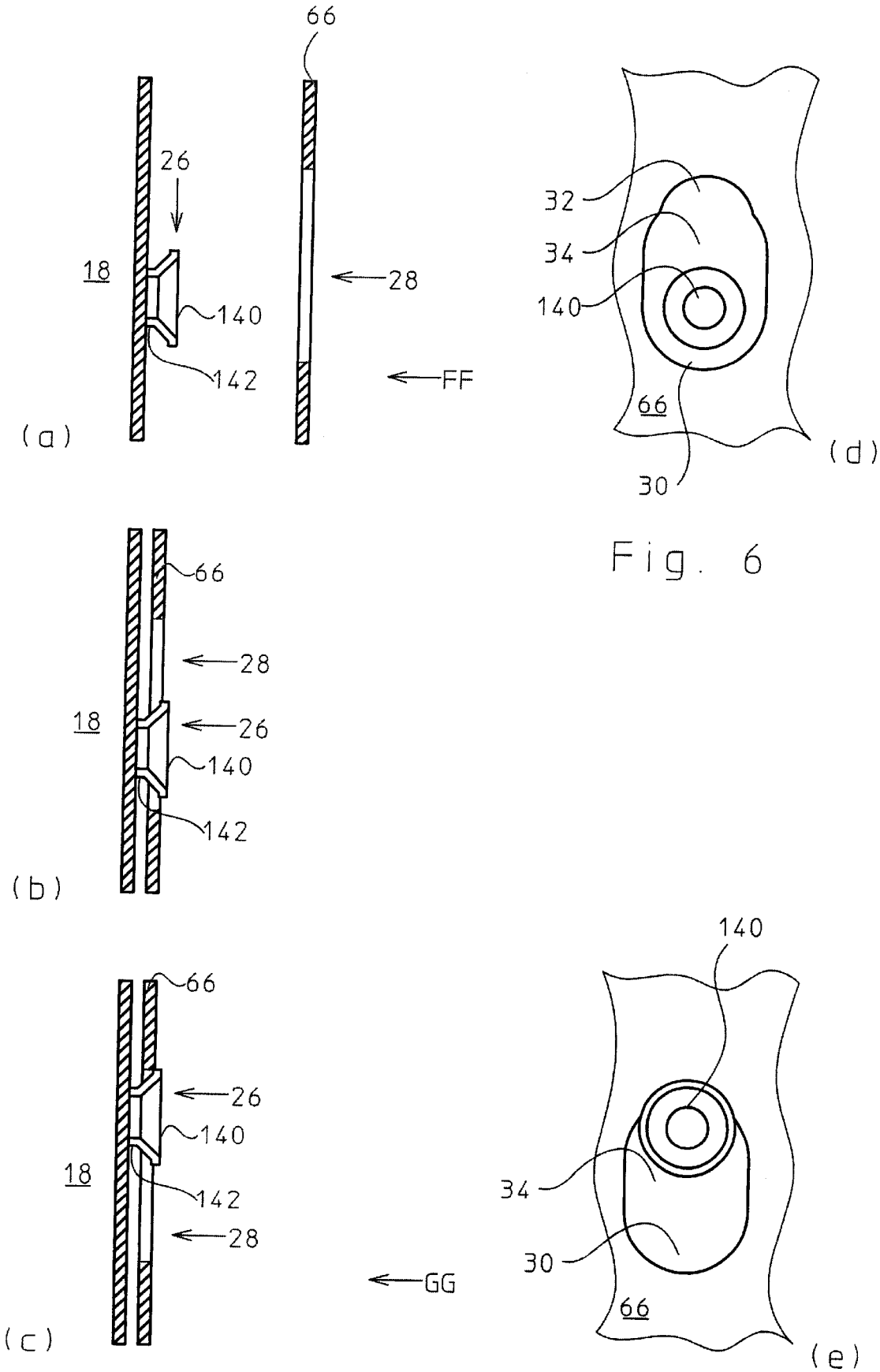

FIGS. 6(*a*)–(*e*) are views of a lock mechanism for the embodiment of FIG. 1 with some parts broken away to show operation of a door lock mechanism. FIG. 6(*a*) is a cross sectional view of a projecting pin with a pin head secured to the side plate along with a cross sectional view of a back panel of the door when the door lock mechanism does not operate. FIG. 6(*b*) is a cross sectional view of the projecting pin secured to the side plate along with a cross sectional view of the back panel of the door when the door lock mechanism starts to operate. The projecting pin penetrates through a large opening of the engaging opening. FIG. 6(*c*) is a cross sectional view of the projecting pin secured to the side plate along with a cross sectional view of the back panel of the door when the door lock mechanism locks the door. The projecting pin, having penetrated through the large opening, now slides up to a small opening.

Figure 7:
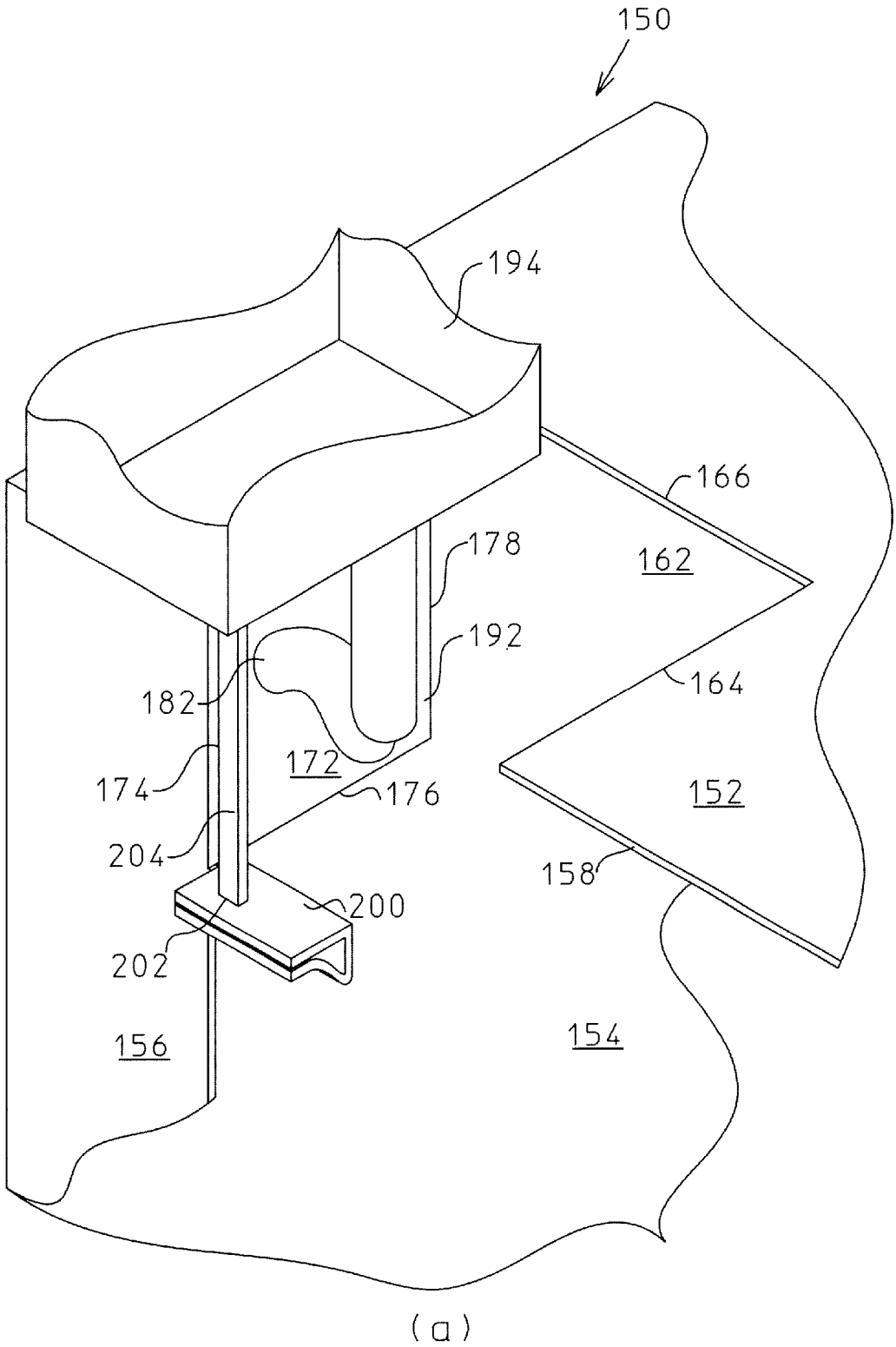

FIG. 7 is a perspective view of a hinge mechanism of another aspect according to the present invention. A door hingedly connected to a case is completely open. A door stopping bar sits on a lever of a side plate of the case. The door is in the latched position.

DETAILED DESCRIPTION OF THE INVENTION

With reference to the drawings, FIG. 1 shows a cabinet case 10 with a front panel or door 12 open and at a latched position. The cabinet case 10 has an enclosure or a case 14 with a front opening 16. At a left side of the front opening 16 a side plate 18 is secured to a case left edge 20. Another side plate 18 is secured to a case right edge 22 of the front opening 16. At the top of the left and right side plates 12, a hinge system (or mechanism) 24 is installed to hinge the door 12 to the case 14. Around mid height of the left and right side plates 18, projecting pins 26 are installed, respectively. The hingedly connected door 12 has two key holes 28 at left and right sides, respectively. Each key hole 28 has a large opening 30 and a small opening 32, which are connected a narrow path 34. The left projecting pin 26 engages with the left key hole 28 and the right projecting pin 26 engages with the right key hole 28 when the door is locked.

Referring to FIG. 2, the door 12 is now swinging up to open the cabinet case 10 or swinging down to close the cabinet case 10 as shown by Arrow AA. The door opening and closing operations will be explained with reference to FIG. 3.

FIG. 3(*a*) shows the cabinet case 10 when the door 12 is closed. The case 14 has a top panel 36 and two side panels 38. The top panel has two hinge openings 40 at left and right sides near the front opening 16, respectively. When the door 12 is about to open, the door 12 is pushed (or pulled) up vertically as shown by Arrow BB such that a door lock may be released and the door 12 starts to depart from the front opening trim as shown FIG. 3(*b*).

The door 12 is now separated from the trimming frame of the front opening 16 as shown FIG. 3(*b*). When the door 12 is pushed (or pulled) up (FIG. 3(*a*)), the door 12 is moved forward because of the hinge mechanism, which will be described in details later. In this position the lock mechanism is released such that the projecting pins 26 may be moved out or almost moved out from the key hole 28. Therefore, the bottom portion of the door 12 may be pulled forward as shown by Arrow CC. Since the top portion of the door 12 is connected to the case 14 via the hinge mechanism 24, the door 12 starts to swing up when the bottom portion of the door 12 is pulled forward as shown in FIG. 3(*c*).

The cabinet case 10 now starts to show its front opening as shown in FIG. 3(*c*). The door 12 may be continued to open if the bottom portion of the door 12 is pulled up as shown by Arrow DD. However, the door may swing back to close the front opening 16 if the pulling force is removed during this process. The door 12 has some weight and tends to fall with gravity but the top portion of the door 12 is connected to the case 14 such that the top portion does not fall. Therefore, the door 12 swings down like a seesaw with one hand full of heavier weight.

The door 12 can be pulled up to become almost horizontal as shown in FIG. 3(*d*). However, with this embodied cabinet case, the top and back edge of the door 12 may contact the top panel 36 of the case 14 to prevent the door from further opening. If the contact between them is prevented, the door 12 may swing even higher.

After the door 12 swings up to be almost horizontal, the door 12 may be pulled forward as shown by Arrow EE such that the hinge mechanism is latched. Because of the latch mechanism the door 12 does not swing down to close the cabinet case 10. The latch mechanism will be described in details later.

FIGS. 4(*a*)–(*e*) illustrate the hinge mechanism 24 and operation thereof. Although FIG. 4(*a*) shows the left-and-top corner of the front opening 16 with broken door 12 and case 14, the same or symmetrically identical mechanism applies at right-and-top corner of the front opening 16. The case 14 has the top panel 36 with the hinge opening 40 next to the front opening 16, which is surrounded by first, second, and third edges 42, 44, 46 and has one open side open to the front opening 16. Therefore, the hinge opening 40 is formed in a cup- or C-shape on the top panel as shown in FIGS. 4(*a*)–(*e*). The top panel 36 defines the upper end of the front opening 16 by first and second top front edges 48, 50. The first and second top front edges 48, 50 are separated by the hinge opening 40.

The left side panel 38 is connected to the top panel 36 at the top edge and to the side plate 18 at the case left edge 20. The side plate 18 is also connected to the top panel 36 at the second top front edge 50. The left side plate 18 has an inner edge 52 along a right side of the plate 18 and an opening defined by L-shaped edges at the right-and-top corner of the side plate 18, where an axis holding plate 54 is fixed at the vertical edge of the L-shaped edges. The axis holding plate 54 may be formed by bending an upper part of the side plate 18 (i.e., it was originally a part of the side plate.) at the vertical edge of the L-shaped edges with a right angle from the side plate 18 after the upper part of the side plate 18 is cut along a first latch edge 56, which is the bottom edge of the L-shaped edges.

The axis holding plate 54 has a axis fixing portion 58, on which an axis 60 is securely fixed. The axis 60, therefore, extends rightward from the axis fixing portion 58 on the axis holding plate 54 and has a stopping end 62 at the tip end of the axis 60. The axis 60 holds a hinge plate 64 between the axis holding plate 54 and the stopping end 62 such that the axis 60 can pass through an opening of the hinge plate 64 but neither the axis holding plate 54 nor the stopping end 62 can pass through it.

The hinge plate 64 is fixed to the door 12 or the back plate 66 at the top edge (a hinge plate fixing portion 68) of the plate 64. The hinge plate 64 is surrounded by the top edge (68), a hinge front edge 70, a first hinge chamfered edge 72, a projecting portion 74, a second latch edge 76, a bottom edge 78, a second hinge chamfered edge 80, and a hinge back edge 82 if viewed counter-clockwise. The hinge plate 64 also has an opening for receiving or bearing the axis 60, which comprises a first position 84 and a second position 86, and transition position 88. In the first position the door 12 can swing and at the second position the door 12 may not swing, which will be explained later. The hinge front edge 70 is horizontal in FIG. 4(*a*) (and perpendicular to the top edge) extending straight until the first hinge chamfered edge 70, which is designed to allow the hinge plate 64 to turn around the axis 60 when the axis 60 is in the first position. The projecting portion 74 is designed to latch the hinge mechanism by letting the second latch edge 76 engage with the first latch edge 56 of the side plate 18 and by letting the bottom edge 78 rest on the first latch edge 56 when the door is opened. The detailed operation will be explained later. The bottom edge 78 is connected to the second hinge chamfered edge 80, which in turn is connected to the hinge back edge 82 that is parallel with the hinge front edge 70.

FIG. 4(*a*) shows the hinge mechanism 24 when the door 12 is closed. The figure corresponds to FIG. 3(*a*). The axis 60 is positioned in the second position 86 such that the door may not swing since the door 12 is locked with the lock mechanism as described later. The hinge plate 64 is positioned between the axis holding plate 54 and the stopping end 62 with the axis 60 passing through the opening of the hinge plate 64. Thus, the hinge plate 64 is parallel or almost parallel with the axis holding plate 54, which is vertical or almost vertical. The top edge (the hinge plate fixing portion 68) is vertical and in front of the front opening 16 such that the door 12 may close the front opening 16. Therefore, the hinge front edge 70, which may or may not touch the first latch edge 56, is horizontal and at the bottom of the hinge plate 64. The axis is in the second position because the weight of the door 12 pull down the hinge plate 64 to let the axis 60 find the highest position (the second position 86) in the opening.

FIG. 4(*b*) shows the hinge mechanism 24 when the door is pulled up or pushed up vertically. The figure corresponds to FIG. 3(*b*). The arrangement of the components are basically the same as shown in FIG. 4(*a*) except the hinge plate 64 being lifted and moved forward as the axis 60 slides along front and back guide edges 90, 92 of the opening. (Or the guide edges 90, 92 slide around the axis 60 because the hinge plate 64 is pulled up while the axis stays still with the case 14.) The front and back guide edges 90, 92 are, therefore, bearing portions. The hinge plate 64 first vertically lifted up until the axis 60 touches the front guide edge 90. Since the front guide edge 90 is curved to form a slope, which makes some angles more than 0 but less than 90 degrees against the horizontal line, the front guide edge 90 slides on the axis 60 to move the hinge plate 64 forward while the hinge plate 64 (or the door 12) is being lifted up. Therefore, the area sided by the front and back guide edges 90, 92 may be called a transition position 88. The axis 60 is, thus, in the first position 84. Some space between the door 12 and the case 14 is created so that the door has freedom to swing around the axis 60.

FIG. 4(*c*) shows the hinge mechanism 24 when the door is being swung up (or down). The figure corresponds to FIG. 3(*c*). The axis 60 is still in the first position 84 so as to allow the door to swing. The hinge plate fixing portion 68 now makes some angle (more than 0 and less than 90 degree) against the horizontal line. Since the hinge plate 64 is appropriately chamfered at the first hinge chamfered edge 72 and lifted up, the hinge plate 64 is not blocked by the first latch edge 56. Conversely, the hinge plate 64 is well designed with the peripheral shape and size, and the opening position, pattern and size to avoid any blockage and to operate the latch mechanism properly as described later.

FIG. 4(*d*) shows the hinge mechanism 24 when the door 12 is opened to become horizontal like the door 12 in FIG. 3(*d*). In FIG. 4(*d*), however, the axis 60 is still in the first position such that the projecting portion 74 is far from the first latch edge 56 of the side plate 18. The door 12 is still being pulled at this time because the door 12 may swing back or down if the pulling force is removed. This is because the door has some weight and the axis 60 is somehow constrained in the opening such that the bottom portion of the door 12 may fall first to make the door 12 swing down around the axis 60. In order to hold the door open, the hinge mechanism may be latched by pulling the door 12 forward. Because the front guide edge 90 is angled to be a slope, the hinge plate 64 (or the door 12) may lowered gradually while the door 12 is pulled forward. The back guide edge 92 helps the hinge plate come down gradually.

FIG. 4(*e*) shows the hinge mechanism 24 when the door 12 is latched in the open position. The figure corresponds to the FIG. 3(*d*). The hinge plate fixing portion 68 is horizontal like the door 12 and the hinge front and back edges 70, 82 are vertical. The bottom edge 78 sits on the first latch edge 56 to hold the door 12 open. The second latch edge 76 of the projecting portion 74 may contact the front face of the side plate 18 near the first latch edge 56 so that the door 12 may be prevented from swinging down by turning around the axis 60. Since the door 12 has some weight and is pivotably secured around the axis 60 as mentioned before, the door 12 tends to turn counterclockwise around the axis 60 in FIG. 4(*e*). However, the bottom edge 78 sits on the first latch edge 56, which is located between the pivotable axis 60 and the center of gravity of the door 12. Thus, the down force moment by the door weight is cancelled by the resisting upward force moment. Since the length from the center of gravity of the door 12 to the pivotable axis 60 is longer than that from resisting upward force working point to the pivotable axis 60, the first latch edge 56 may have to endure the door weight and more if only one first latch edge is employed for the cabinet case 10.

FIG. 5 shows an example of the hinge plate 100. The hinge plate 100 includes a flat plate surrounded by a hinge plate fixing portion 102, a hinge front edge 104, a first hinge chamfered edge 106, an projecting portion 108, a second latch edge 110, a bottom edge 112, a second hinge chamfered edge 114, and hinge back edge 116. The hinge plate 100 also includes an opening comprising a first position 120, a second position 122, a front guide edge 124, and a back guide edge 126. In the example, the hinge fixing portion is composed of a rib plate 128 and two bolt holes 130. The hinge plate of the example may be fixed on the back panel of the door 12 with screws or bolts.

With reference to FIGS. 6(*a*)–(*e*), the lock mechanism is described. FIG. 6(*a*)–(*c*) show cross sectional views of the projecting pin 26 installed on the front face of the side plate 18 and the back plate 66 of the door 12 with broken parts. FIGS. 6(*d*) and (*e*) are front views by Arrows FF and GG, respectively. In this particular embodiment, the door 12 comprises a back panel, a front panel and side members connecting the back and front panels. The projecting pin comprises a pin head 140 and pin stem 142, which is fixed on the side plate 18. The pin head may be round like semisphere so that the curved top may direct the projecting pin by contacting the hole brim to the center of a hole, which engages with the projecting pin 26. The back panel 66 has the key hole 28, which comprises the large opening 30 and the small opening 32, which are connected via a narrow path 34. The projecting pin 26 and the key hole 28 are arranged to engage with each other when the door 12 closes.

FIGS. 6(*a*) and (*d*) show the lock mechanism when the door 12 is about to swing down to close the cabinet 10. The hinge mechanism is adjusted to such relative height and position as shown in FIGS. 6(*a*) and (*d*). In the figure, the pin head 140 is centered of the large opening 30 in FIG. 6(*d*) so that the pin head 140 easily passes through the large hole 30. However, a small deviation may be self-adjusted at the curved head of the pin head 140 and a peripheral edge of the large opening 30.

FIG. 6(*b*) shows the lock mechanism when the door 12 is closed but the door is still lifted. The pin head 140 has passed through the large opening 30 and the back plate 66 is located between the pin head 140 and the side plate 18. In this particular embodiment, the displacement from the front opening 16 to the back plate 66 by the hinge mechanism is small. The figure, therefore, corresponds to FIG. 4(*b*) although the FIG. 4(*b*) shows the mechanism when the door is about to open.

FIGS. 6(*c*) and (*e*) show the lock mechanism when the door 12 is closed. After the pin head 140 passes through the large opening 30, the door 12 is lowered or dropped by gravity. The pin stem 142 slides the narrow path 34 of the back panel key hole 28. (The narrow path 34 actually moves down relative to the projecting pin 26 when the door 12 is dropped.) Thus, the pin head 140 can be seen as shown in FIG. 6(*e*) if viewed by arrow GG.

FIG. 7 shows another embodiment explaining another aspect of the present invention. Most components are common with the previous embodiment and FIG. 4(*e*) may be referred to for comparison. The figure shows another embodiment of the hinge mechanism, which may apply to the previous embodiment shown in FIGS. 3(*a*)–(*d*). A case 150 comprises a top panel 152, a side panel 154 and side plate 156. The top plate 152 comprises first and second top front edges 158, 160 and a rectangular hinge opening 162 surrounded by first, second, and third edges 164, 166, 168 in a similar manner in FIGS. 4(*a*)–(*e*). The top panel 152 is connected to a side panel 154 at the left edge. The side panel 154 is connected to a side plate 156 at a left side edge 170. The side plate 156 is also connected to the top panel 152 at the second top front edge 160. The side plate 156 is connected to a fixed hinge plate 172, which may be formed by bending a part of the side plate 156 along a vertical right edge 174. The fixed hinge plate 172 is surrounded by fixed hinge plate bottom edge 176 and a fixed hinge plate back edge 178.

The fixed hinge plate 172 has an L-opening 180 which comprises a fixed hinge first position 182, a fixed hinge second position 184, a fixed hinge transition position, a fixed hinge front guide edge 186, and a fixed hinge back guide edge 188. The fixed hinge first position 182 is located at the most front and highest position and the fixed hinge second position 184 is located at the most rear and lowest position of the L-opening 180. In the figure, a axis 190 passes through the L-opening 180 which extends from the lower portion of a axis support member 192. The axis support member is secured to the door 194 at a axis support member fixing portion 196.

At lower portion of the side plate 156 than the fixed hinge plate 198, a latch member 200 extends horizontally from the side plate 156. The latch member may be formed by cutting the side plate 156 vertically to some extent and bending the cut part toward the front. In order to make the latch member steady, upper and lower parts may be bent at the same time to form double layered fixed hinge plate 172. Around a bar resting area 202, a topping bar, which is fixed at the top edge (stopping bar fixing portion 206) and extending down vertically from the stopping bar fixing portion 206 to the resting area 202.

The figure shows the hinge mechanism when the door 194 is open and kept open. The axis 190 is in the second position 184 and the stopping bar 204 is sitting on the bar resting area 202 to resist the downward force caused by the door weight and axis 190 in the similar manner as described with reference to FIG. 4(*e*).

In order to close the door 194, the bottom portion of the door 194 may be lifted up to release the latch mechanism on the latch member 200 and the door may be pulled forward to move the axis 190 forward and upward, such that the stopping bar 204 disengages from the bar resting area 202 and the door may turn counterclockwise without the stopping bar touching the latch member 200. When the door 194 is swung down to close the cabinet case, the upper part of the door 194 may be pushed to move the axis 208 from the first position 182 to the second position 184 so that the axis settles in the second position 184. During the last process the lock mechanism allows the pin head 140 of the projecting pin 26 to pass through the large opening 30 and slide through the narrow path 34 into the lock position.

In the foregoing description, although only the left hinge mechanism of the two hinge mechanism is explained, the other mechanism may be identical or symmetrically identical so that the same explanation may apply to the other mechanism. Since the present invention utilizes the door weight, the present invention may apply best to the equipment having a middle range of door weight. However, the invention may also be applied to equipment with a heavy door. It may be even better for such an application if the heavy weight can be cancelled by a counter spring force or the like.

Although the latch mechanism is incorporated in the hinge plate in the first embodiment, the latch mechanism may installed separately from the hinge mechanism.

In the foregoing embodiment, a pair of hinge mechanisms are employed for the cabinet case. However, it should be understood that only one hinge mechanism or more than two hinge mechanisms may be applied to the hinged-door cabinet.

In the foregoing embodiment, although only box-shaped cabinet case is employed, the present invention may apply to other types of cases such as a round shape.

Although foregoing embodiments show a door to swing only upward, the present invention may apply to the cabinet which has a door to swing in any direction.

It should be understood that the components may be made of metal such as steel, and other materials such as organic material and inorganic materials.

It should also be understood that the foregoing relates only to preferred embodiments of the present invention, and thus changes and modifications thereto may be made without departing from the spirit and scope of the invention as defined in the following claims.

What is claimed is:

1. An axis receiving member for a hinge mechanism for a door to open and close, which comprises an axis fixed to a case, wherein the axis is received by the axis receiving member which is fixed to the door, the axis receiving member comprising:

a flat plate;

a fixing portion to the door;

a curved elongated opening such that the axis passes through, slide in an elongated direction, and turns in the opening;

the curved elongated opening being formed to extend partially in parallel with the door and to curve away from the door; and a projecting portion which engages with an edge portion fixed to the case.

2. A hinge mechanism for a door hingedly connected to an enclosure, comprising:

an axis;

an axis receiving member which bears the axis, the axis receiving member having at least two positions;

in a first position the axis receiving member is operative whereby the axis turns so as to swing the door; and in a second position axis receiving member is selectively operative so that the door is held open wherein the door is farther from the enclosure when the axis is at the first position than when the axis is at the second position.

3. A hinge mechanism for a door hingedly connected to an enclosure, comprising:

an axis;

an axis receiving member which bears the axis, the axis receiving member having at least two positions;

in a first position the axis receiving member is operative whereby the axis turns so as to swing the door;

in a second position axis receiving member is selectively operative so that the door is held open; and a latch mechanism for keeping the door open comprising, a projecting portion of the axis receiving member, and an edge portion of a side plate fixed to the enclosure.

4. A hinge mechanism for a door hingedly connected to an enclosure, comprising:

an axis;

an axis receiving member which bears the axis, the axis receiving member having at least two positions;

in a first position the axis receiving member is operative whereby the axis turns so as to swing the door;

in a second position axis receiving member is selectively operative so that the door is held open;

a door lock mechanism comprising, a projecting pin and an engaging opening such that the projecting pin engages with the engaging opening when the door lock mechanism operates.

5. The hinge mechanism according to claim 4, comprising:

a pin head being disposed at a tip top of the projecting pin;

a pin stem between the pin head and a back plate to which the projecting pin is secured;

a narrow path on a back plate of the door; and wherein the projecting pin slides along the narrow path with the back plate positioned between the pin head and the back plate.

* * * * *